US006098907A

United States Patent [19]

Kato

[11] Patent Number: 6,098,907

[45] Date of Patent: Aug. 8, 2000

[54] DISMANTLING METHOD OF TANK OR THE LIKE

[75] Inventor: Hideo Kato, Oita, Japan

[73] Assignee: Kyuseki Kogyo Co., Ltd., Oita, Japan

[21] Appl. No.: 09/125,153

[22] PCT Filed: Dec. 19, 1997

[86] PCT No.: PCT/JP97/04726

§ 371 Date: Aug. 12, 1998

§ 102(e) Date: Aug. 12, 1998

[87] PCT Pub. No.: WO98/28507

PCT Pub. Date: Jul. 2, 1998

[30] Foreign Application Priority Data

Dec. 20, 1996 [JP] Japan ..... 8-354610

[51] Int. Cl.[7] ..... B02C 19/00

[52] U.S. Cl. ..... 241/30; 29/426.4

[58] Field of Search ..... 29/426.4; 30/131, 30/134; 241/30

[56] References Cited

U.S. PATENT DOCUMENTS

| | | | |
|---|---|---|---|
| 5,197,193 | 3/1993 | Smith | 30/131 |
| 5,395,598 | 3/1995 | Kato | 29/426.4 |

FOREIGN PATENT DOCUMENTS

| | | |
|---|---|---|
| 56-48669 | 12/1977 | Japan . |
| 3-45187 | 12/1983 | Japan . |
| 61-242263 | 4/1985 | Japan . |
| 62-185965 | 2/1986 | Japan . |
| 2-311666 | 5/1989 | Japan . |
| 5-280204 | 3/1992 | Japan . |

*Primary Examiner*—Mark Rosenbaum
*Attorney, Agent, or Firm*—Smith, Gambrell & Russell, LLP

[57] ABSTRACT

To ensure safe and easy demolition of tanks effectively in a short length of time, while significantly enhancing safety and saving much labor, by a work vehicle 3 with an attachment 1 having cutting edges that can be freely opened and closed for boring and cutting-off operations, a bore 10*a* is formed in a side wall of a tank 10. A notch is made in the side wall of the tank 10, starting from the said bore 10*a*. The bore 10*a* is expanded by means of removing a cut-off piece. Before the tank 10 buckles, it is supported at the position above the bore 10*a*. A notch is made in the side wall of the tank 10. The bore 10*a* is expanded by means of removing a cut-off piece. Then, a support force against the tank 10 is adjusted by a work vehicle 4 to buckle the tank 10 while utilizing a self weight of the upper portion of the tank 10. The buckled tank 10 is handled by the work vehicles 3 and 4.

2 Claims, 3 Drawing Sheets

DISMANTLING METHOD OF TANK OR THE LIKE

TECHNICAL FIELD

The present invention relates to a method for demolishing a tank and, more particularly, to a method for demolishing a tank including oil tanks and tower storage tanks such as steel storage silos for grains or pasture grass.

BACKGROUND ART

As a method for demolishing a tank, for example, Japanese Patent Laid-open No. 62-185965 describes a method comprising: shearing a side wall of a tank at a lower portion thereof to divide the tank into upper and lower sections along a spiral shear line provided on the periphery of the tank and a shear line connecting the starting and ending points thereof, interposing at a spiral shear region a rotation member that rotationally support the upper section of the storage tank, and successively cutting off the upper section of the storage tank in the form of an extension of the spiral on the upper side wall of the storage tank including a stepped portion of the shear line while rotating the upper section of the storage tank such that the stepped portion of the shear line approaches.

In addition, Japanese Patent Laid-open No. 5-280204 describes a method in which a side wall of a tank is separated from a bottom plate thereof, and the side wall is sheared spirally in the direction from the lower end to the upper end while being temporarily supported by, for example, a jack, to remove the cut-off piece.

According to the method described in the above-mentioned Japanese Patent Laid-open No. 62-185965, no link operation is necessary with a jack and thus there is no danger which otherwise may be involved in operation of the jack. However, it is not easy to interpose the rotary support member at the spiral cut-off region and to rotate the upper section of the tank.

On the contrary, according to a demolition method described in the above-mentioned Japanese Patent Laid-open No. 5-280204, operation can be made safely and easily because it is not necessary to interpose the rotary support member and to rotate the upper section of the storage tank. However, the demolition requires a significant time due to the necessity of the temporary support of the side wall by means of, for example, the jack.

In addition, demolition of a tank through, for example, fusing by an operation is time-consuming. Furthermore, meticulous care and much effort are required to ensure safety for the operator.

Taking these into consideration, the demolition of tanks is made by using a mechanical force rather than manpower. Such a technique has thus been desired that ensure safe and easy demolition of tanks effectively in a short period of time, while significantly enhancing safety and saving much labor.

SUMMARY OF THE INVENTION

The means to solve problems according to the present invention is as follows.

Firstly, there is provided a method for demolishing a tank by a work vehicle with an attachment having cutting edges that can be freely opened and closed for boring and cutting-off operations, comprising: forming a bore in a side wall of a tank; shearing the side wall of the tank horizontally, starting from the said bore and then shearing it vertically, and removing a cut-off piece to expand the bore; before the tank buckles, supporting the tank at the position above the bore; further shearing the tank in the right and left directions above the bore; adjusting a support force against the tank to buckle the tank while utilizing a self weight of the upper portion of the tank; and handling the buckled tank pieces.

Secondly, there is provided a method for demolishing a tank by a work vehicle with an attachment having cutting edges that can be freely opened and closed for boring and cutting operations, comprising: forming a bore in a side wall of a tower or a silo at a lower portion thereof; shearing the side wall of the tower or the silo circumferentially at the lower portion thereof, starting from the said bore, and removing a cut-off piece to expand the bore; before the tower or the silo buckles, supporting the tower or the silo at the position above the bore; adjusting a support force against the tower or the silo to buckle and overturn the tower or the silo while utilizing a self weight of the tower or the silo; and handling the buckled and overturned tower or silo pieces.

The LaBounty shear (trade name) is preferable as the attachment having cutting edges that can be freely opened and closed for boring and cutting operations. It is desirable to mount the said attachment on a boom or an arm, at the tip of it, of a typical hydraulic excavator as a work vehicle used in the present invention.

According to the tank demolition method of the present invention, a tank is demolished by means of a mechanical force rather than manpower. This provides safe and easy demolition of tanks in a short time in an effective manner to significantly enhance safety and save labor.

In addition, it contributes for work vehicles, with the attachment such as the LaBounty shear having cutting edges that can be freely opened and closed for boring and cutting operations, to finding wider applications by means of making advantages of positive, systematic, and time-saving shearing of steel products (mainly iron plates).

Figure 1:
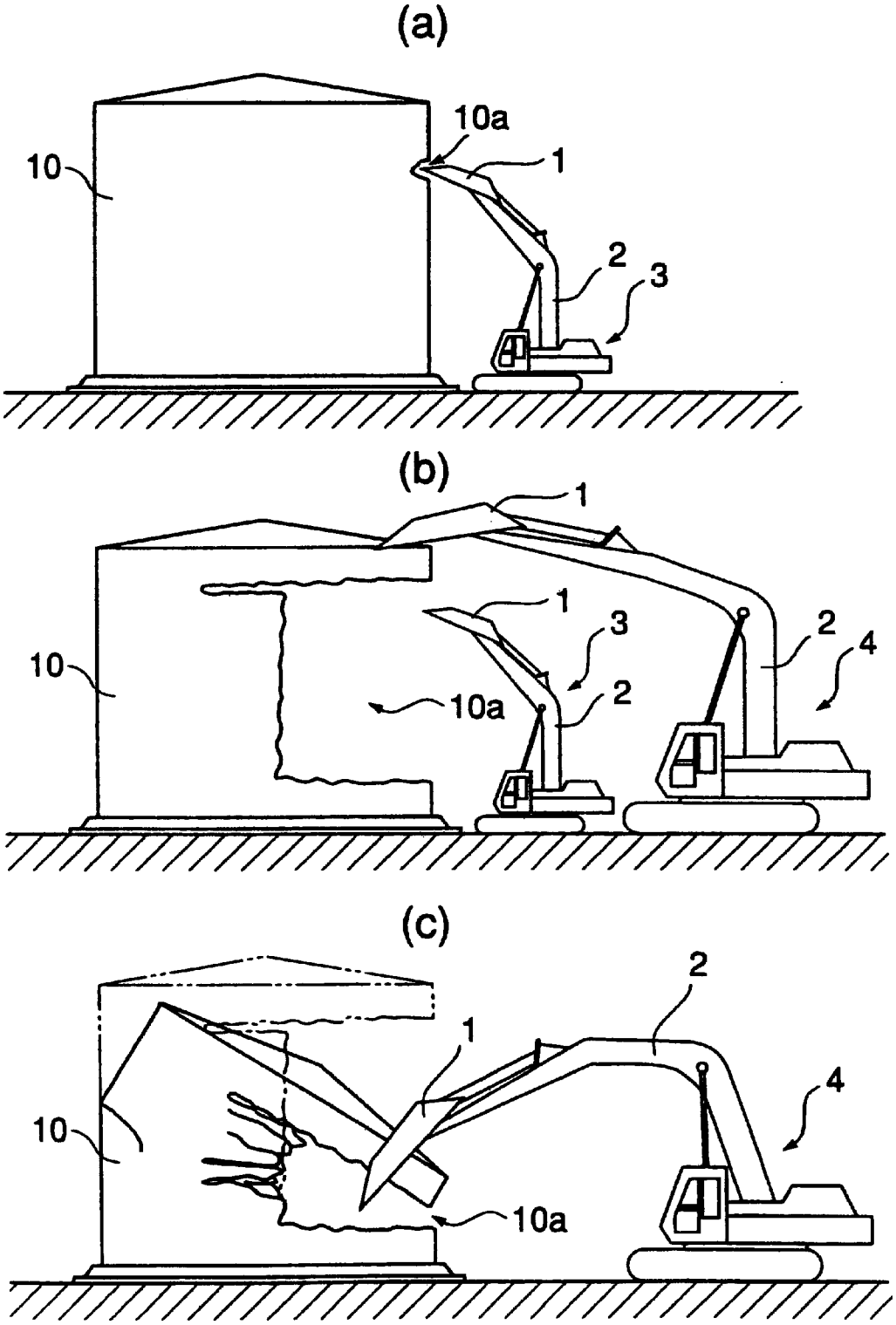
FIG. 1 is a schematic view illustrating an example of oil tank demolition according to a tank demolition method of the present invention.

Reference numerals in the figures are as follows.

1 an attachment
2 a boom
3 a work vehicle (LaBounty shear)
4 a work vehicle (nibbler (long))
5 a truck crane
10 a tank
10*a* a bore
11 a silo
11*a* a bore
12 lifting lug

BEST MODE FOR CARRYING OUT THE INVENTION

Example of the present invention are described with reference to the drawings.

EXAMPLE 1

In this Example, the LaBounty shear (trade name) is used as an attachment 1 having cutting edges that can be freely opened and closed for boring and cutting operations to demolish a cylindrical tank of about 15 m in diameter and about 12 m in height. Two work vehicles are used: a work vehicle 3 of a hydraulic excavator with a boom 2 where the said attachment 1 is mounted at the tip of the boom, and a work vehicle 4 (nibbler (long)) with a boom 2 on which such an attachment is mounted that can grasp a thing freely.

Two work vehicles 3 and 4 may be used even when they have the same dimensions including the length of the boom 2, provided that one work vehicle 3 does not interfere with the other work vehicle 4. That is, it is enough that one work vehicle 3 can conduct boring and shearing operations for the tank 10 while the other work vehicle 4 supports the upper portion of the tank 10.

Figure 2:
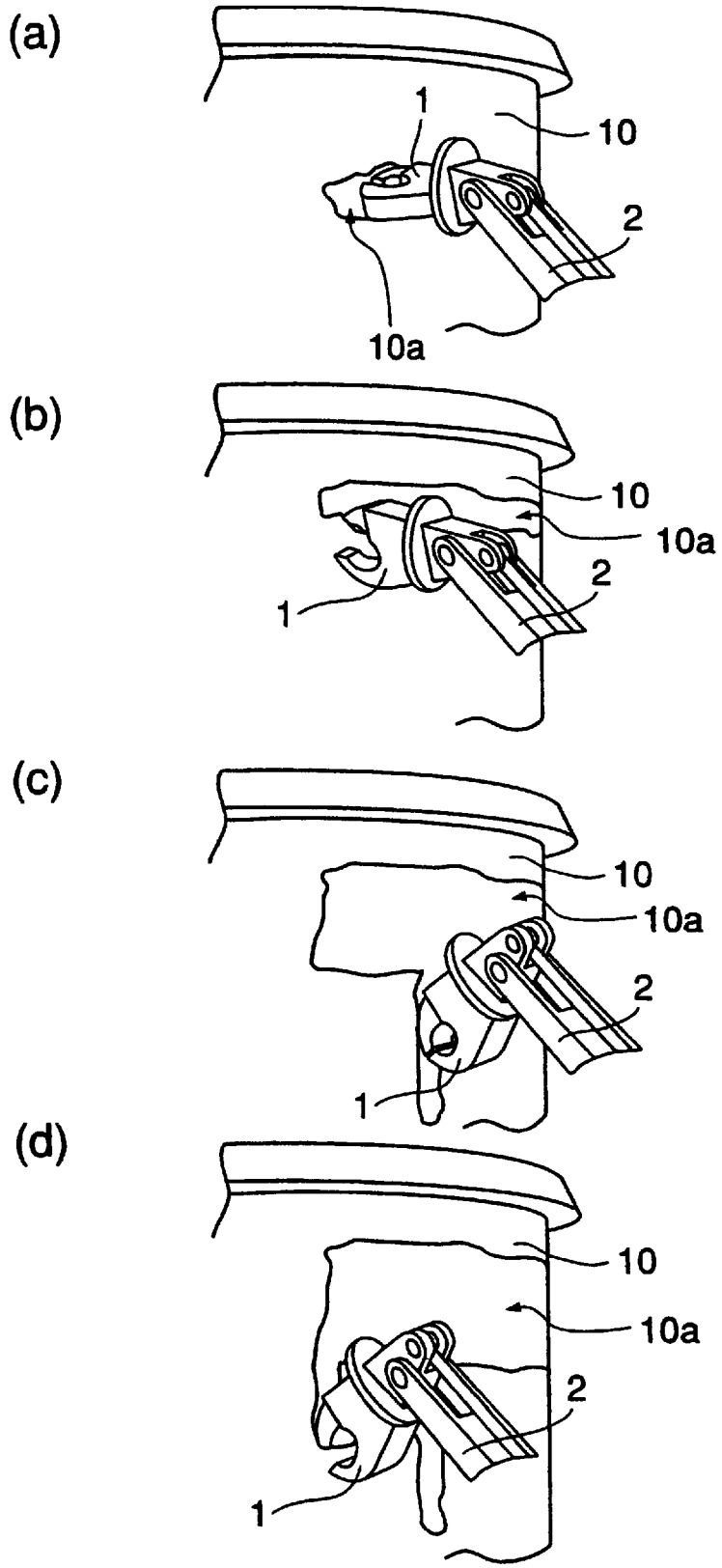
FIG. 2 is an enlarged perspective view of essentials of the example of the oil tank demolition according to the tank demolition method of the present invention.

Firstly, as shown in FIG. 1(*a*) or FIG. 2(*a*), a bore 10*a* is formed in the side wall of the tank 10 at a point about 10 m above the ground in an upper portion of the tank, by means of boring by the work vehicle 3 with the LaBounty shear (trade name) as the attachment 1 mounted on the boom 2 at the tip thereof.

Then, as shown in FIG. 2(*b*), one tine is hooked to shear the side wall of the tank 10 starting from the bore 10*a*, as tearing it horizontally. The bore 10*a* is thus expanded 3 m vertically and 10 m horizontally along the peripheral surface. Subsequently, one tine is hooked to shear about 7 m vertically from the center of the said bore 10*a*, as tearing it as shown in FIG. 2(*c*).

Furthermore, as shown in FIG. 2(*d*), a notch is formed by tearing off vertically from the ends of the bore 10*a* and the cut-off piece is removed away to expand the bore 10*a*.

Thereafter, the bore 10*a* is gradually expanded by means of shearing horizontally, shearing vertically, and then removing the cut-off piece.

In the middle before buckling of the tank, i.e., before the sheared and removed portion reaches about half around the tank 10, taking a weight balance of the upper surface and strength of the side wall of the tank 10, the other work vehicle 4 grasps the portion above the center of the bore 10*a* and supports it as shown in FIG. 1(*b*).

While grasping to support the upper portion of the tank 10, another horizontal notch is made and then a vertical notch is made. By removing the cut-off piece, the bore 10*a* is gradually expanded.

When the total area of the removed cut-off piece reaches about ½ of the total surface area of the side wall of the tank 10, the work vehicle 3 that supports the tank 10 is driven as shown in FIG. 1(*c*) to adjust a support force against the tank 10, thereby causing the side wall of the tank 10 to buckle slowly, utilizing the self weight of the upper portion of the remaining tank 10.

A horizontal notch may be formed in the side wall of the tank 10 from both ends of the bore 10*a* in order to ensure that the tank 10 buckles slowly.

The buckled tank 10 is subjected to demolition by means of cutting by a plurality of work vehicles 3 including the work vehicle 4 for supporting the tank 10 in the same manner as in conventional demolition operation.

The tank 10 was demolished practically according to the above-mentioned operation. As a result, the tank was demolished in approximately a half length of time as compared with the method described in Japanese Patent Laid-open No. 5-280204.

In addition, the tank demolition method according to this Example does not require dangerous work accompanying with jack-up operation by an operator and elevated work. Therefore, the operation was made safely and easily.

EXAMPLE 2

In this Example, the LaBounty shear (trade name) is used as an attachment 1 having cutting edges that can be freely opened and closed for boring and cutting operations as in Example 1 to demolish a steel tower silo of about 8 m in diameter and about 30 m in height. A work vehicle 3 of a hydraulic excavator is used with a boom 2 where the said attachment 1 is mounted at the tip of the boom. A truck crane 5 is also used to support a steel silo 11.

Figure 3:
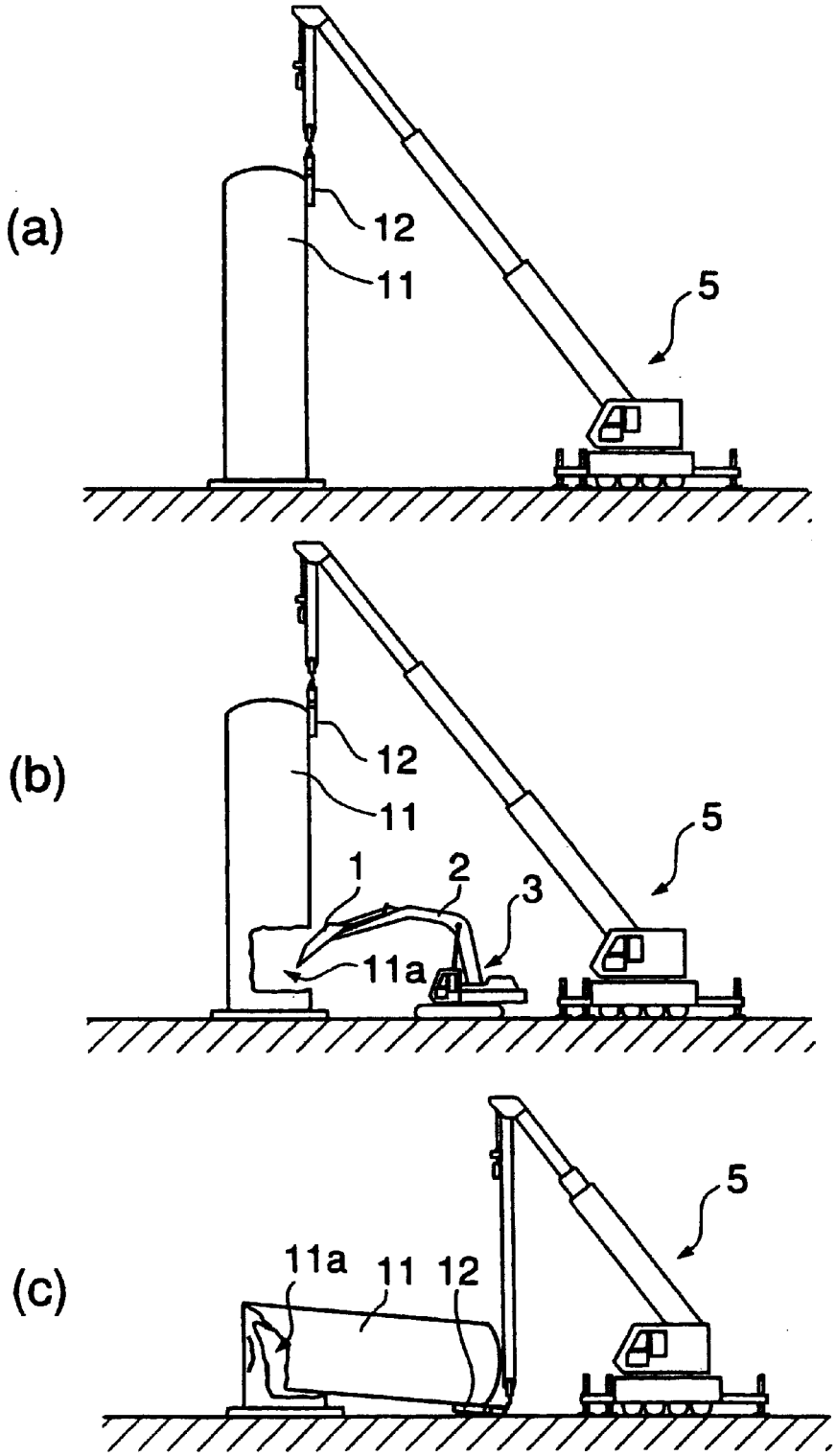
FIG. 3 is a schematic view illustrating an example of silo or similarities demolition according to a tank demolition method of the present invention.

Firstly, the truck crane 5 applies a load of at least 50% of that of the steel silo 11 through a lifting lug 12 attached to an upper portion of the steel silo 11 as shown in FIG. 3(*a*).

Next, a bore 11*a* is formed in the side wall of the steel silo 11 at a point about 5 m above the ground in a lower portion of the steel silo 11 as shown in FIG. 3(*b*), by the work vehicle 3 with the LaBounty shear (trade name) as the attachment 1 mounted on the boom 2 at the tip thereof.

Then, as in Example 1, one tine of the attachment 1 is hooked to shear the side wall of the steel silo 11, as tearing it horizontally and then tearing it vertically. The cut-off piece is removed away to expand the bore 11*a* gradually.

When the length of the bore 11*a* reaches about half around the steel silo 11, the truck crane 5 that supports the steel silo 11 is driven as shown in FIG. 3(*c*), thereby causing the body of the steel silo 11 to buckle and overturn slowly on the side where the bore 11*a* is formed in the steel silo 11, utilizing the self weight of the upper portion of the steel silo 11.

The steel silo 11 buckled and overturned on the ground is subjected to demolition by the work vehicles 3 in the same manner as in conventional demolition operation.

I claim:

1. A method for demolishing a tank by a work vehicle with an attachment having cutting edges that can be freely opened and closed for boring and cutting-off operations, comprising:

forming a bore in a side wall of a tank;

shearing the side wall of the tank horizontally, starting from said bore and then shearing it vertically, and removing a cut-off piece to expand the bore;

before the tank buckles, supporting the tank at the position above the bore;

further shearing the tank in the right and left directions above the bore;

adjusting a support force against the tank to buckle the tank while utilizing a self weight of the upper portion of the tank; and handling the buckled tank pieces.

2. A method for demolishing a tank by a work vehicle with an attachment having cutting edges that can be freely opened and closed for boring and cutting operations, comprising:

forming a bore in a side wall of a tower or a silo at a lower portion thereof;

shearing the side wall of the tower or the silo circumferentially at the lower portion thereof, starting from said bore, and removing a cut-off piece to expand the bore;

before the tower or the silo buckles, supporting the tower or the silo at the position above the bore; adjusting a support force against the tower or the silo to buckle and overturn the tower or the silo while utilizing a self weight of the tower or the silo; and handling the buckled and overturned tower or silo pieces.

* * * * *